United States Patent [19]

Tyree, Jr.

[11] Patent Number: 5,074,343

[45] Date of Patent: Dec. 24, 1991

[54] FILLER FOR SMALL TANKS OR THE LIKE

[76] Inventor: Lewis Tyree, Jr., Mulberry Hill, Liberty Hall Rd., Lexington, Va. 24450

[21] Appl. No.: 514,295

[22] Filed: Apr. 25, 1990

[51] Int. Cl.[5] ..... B67C 11/00

[52] U.S. Cl. ..... 141/300; 141/297; 141/331; 141/340; 141/95; 73/294

[58] Field of Search ..... 141/297, 300, 340–345, 141/331, 332, 95; 73/294

[56] References Cited

U.S. PATENT DOCUMENTS

| | | | |
|---|---|---|---|
| 630,965 | 8/1899 | Wurster | 141/340 |
| 790,463 | 5/1905 | Taliaferro | 73/294 |
| 865,572 | 9/1907 | Dawson | 141/297 X |
| 928,138 | 7/1909 | Lewis | 141/331 |
| 1,033,173 | 7/1912 | Hoaglin | 141/297 X |
| 3,032,080 | 5/1962 | Bures et al. | 141/297 |
| 3,177,907 | 4/1965 | Baldi | 141/300 |
| 3,973,602 | 8/1975 | Kruse | 141/95 |
| 4,202,386 | 5/1980 | Orr | 141/300 |
| 4,338,983 | 7/1982 | Hatcher | 141/331 |
| 4,559,984 | 12/1985 | Wycech | 141/340 |
| 4,600,125 | 7/1986 | Maynard, Jr. | 141/331 X |
| 4,850,403 | 7/1989 | Wiese | 141/95 |
| 4,901,776 | 2/1990 | Attinello | 141/95 |

FOREIGN PATENT DOCUMENTS

| | | | |
|---|---|---|---|
| 1087062 | 2/1955 | France | 141/331 |
| 1179560 | 5/1959 | France | 141/279 |
| 0004856 | of 1905 | United Kingdom | 141/300 |

*Primary Examiner*—Henry J. Recla
*Assistant Examiner*—Casey Jacyna
*Attorney, Agent, or Firm*—Fitch, Even, Tabin & Flannery

[57] ABSTRACT

Filling units for filling small tanks or the like with gasoline, kerosene, or other flowable materials which attach an inlet to such a tank. When the filling unit is in a fill position, a displacer section occupies a substantial volume within the tank. It allows the person filling the tank to supply the liquid until the tank will accept no more and the liquid reaches a predetermined level in a funnel portion of the filler. Thereafter, removal of the displacer section from the tank, as by sliding a section of the overall unit upward, allows the liquid in the funnel to enter the tank and fill the volume evacuated by the displacer section to complete the filling without any spillage. The overall unit may be removed from the tank each filling operation, or it may be designed to include a protective cap that fits over the upward-protruding portion of the unit, allowing the unit to remain mounted on the tank.

15 Claims, 4 Drawing Sheets

FILLER FOR SMALL TANKS OR THE LIKE

This patent is available for licensing or purchase. The invention relates generally to funnel-like fillers and more particularly to such units designed to mount on small tanks.

BACKGROUND OF THE INVENTION

Filling of fuel tanks or the like with gasoline or other liquids presents an ever-present hazard of spillage, either due to poor spout-to-opening control or when overfilling occurs in trying to completely fill the tank. In many such cases, the results are objectionable, either from safety considerations or environmental considerations. Eye-hand control of the filling procedure becomes quite difficult at the time the container becomes nearly full, as the visual warning between nearly full, full and over-full is quite short. A funnel-like filling device designed to greatly reduce these hazards, while allowing complete and rapid filling of a tank or other container with a flowable fluid, is desirable, and such would be particularly useful for use with lawnmowers, outboard engines for boats, kerosene heaters and the like.

More efficient funnels have been the object of many previous inventors who strove to accomplish the complete filling of a small container with a liquid without any spilling. U.S. Pat. No. 4,202,386 to Orr shows a funnel for guarding against overfilling which includes two vents which allow air to escape from the tank being filled. One of the vents is manually closed during the initial part of the filling and is then allowed to open after the lower entrance to the second vent becomes submerged during filling. U.S. Pat. No. 3,973,602 to Kruse shows a filling unit which has a very large bowl into which the gasoline or other liquid is poured, the volume of which is hopefully matched to the volume of the upper portion of the container being filled. A sealing arrangement is provided so that, once an air vent is blocked, further inflow of liquid into the tank is prevented, and after the bowl is filled to a predetermined level, disengagement of the funnel from the tank causes the seal to be broken hopefully allowing all of the liquid to be accommodated within and precisely fill the tank. These funnels have proven to be too slow or too cumbersome to be completely satisfactory. As a result, improved filling units continue to be desired.

SUMMARY OF THE INVENTION

This invention provides a filling unit which includes a displacer that is effective during the filling procedure, which displacer extends into the container during filling, allowing an apparent "overfill". It then can be removed, and when removed, allows all the "overfill" liquid to run into the container.

Such an anti-spill filling unit is preferably provided that attaches in sealing engagement to a fuel tank or the like in the same manner as the fuel tank closure cap, which is first removed to provide entry to the tank. Once the unit is attached, a funnel portion is pushed downward, so that a displacement end section enters the fuel tank as far as permitted. When fuel is then poured into the funnel, it freely flows into the fuel tank, and air or vapor escapes through a vent arrangement which is integral to the unit. Once the tank has become nearly full, the air vent floods, causing fuel flow into the tank to slow so that fuel builds up in the funnel where it is easily observable, allowing further pouring to readily be stopped. The funnel portion is then pulled upward, preferably without breaking the seal to the tank, allowing the fuel within the funnel to drain downward into the empty volume created when the displacement section of the funnel exits from the fuel tank. The anti-spill unit can now be removed from the fuel tank, and the fuel tank closure can be replaced.

By the use of this unit, rapid and complete filling of a container with a flowable fluid can be achieved with minimal risk of spillage.

DETAILED DESCRIPTION OF THE PREFERRED EMBODIMENTS

Illustrated in FIGS. 1 to 5 is a filling unit 11 which is designed to prevent the overfilling of containers having an external attachment means, such as a threaded inlet opening to a small gas tank 13 (shown in dotted outline), to which a cap or the like can be screwed in place to substantially close the tank during normal operating conditions. The filling unit 11 is useful to prevent the overfilling a container of any size and shape with a flowable fluid; however, it is expected to find its primary usefulness to prevent the overfilling of small tanks, such as those commonly found on lawnmowers, snowblowers, outboard motors and the like, with gasoline or the overfilling of space heaters with kerosene.

Figure 1:
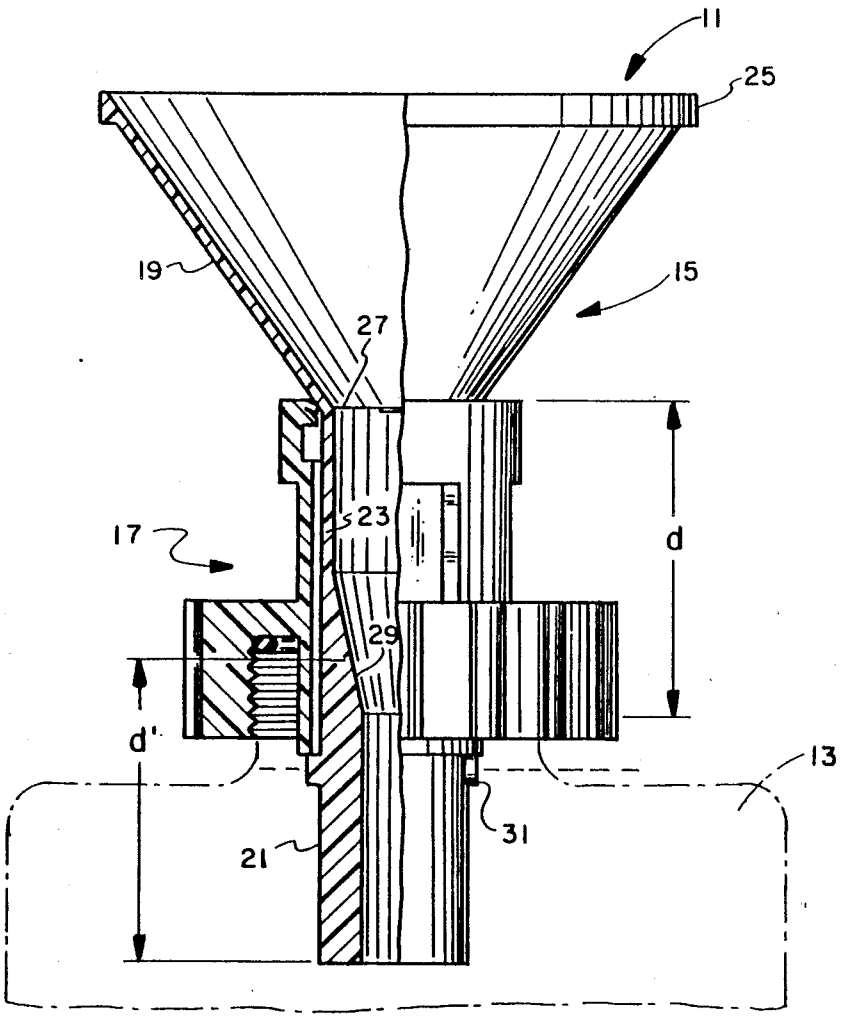
FIG. 1 is an elevational view of a filling unit embodying various features of the invention showing the unit in the downward or filling position, with the left half showing the unit in section.

As best seen in FIG. 1, the filling unit 11 includes a funnel unit 15 and a holder unit 17 which are interconnected with each other in a manner so as to be relatively moveable, preferably slidable. The funnel unit 15 includes an upper funnel section 19, a lower displacer section 21 and an intermediate interconnection section 23. The funnel section 19 is preferably frustoconical in shape extending smoothly downward from an upper circular rim 25 of relatively large diameter to a neck 27 of smaller diameter at the upper end of the intermediate section 23. Although the funnel section is preferably of conical shape, it could have any suitable shape, for example generally hemispherical.

Figure 2:
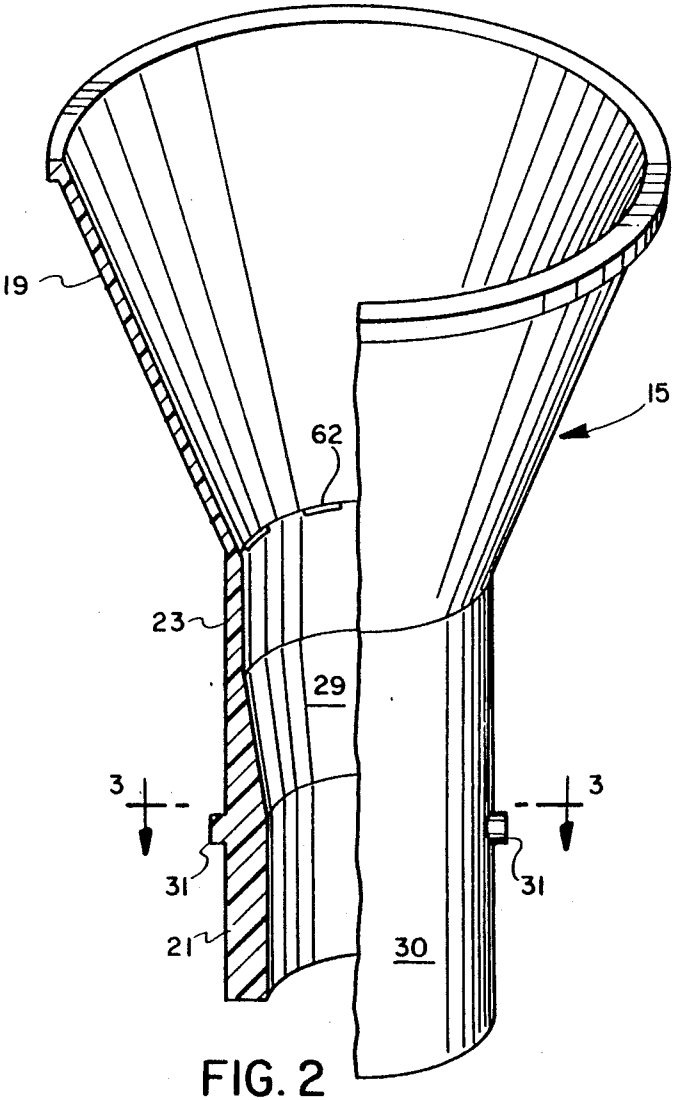
FIG. 2 is a perspective view, with a portion broken away and shown in section, of a funnel portion of the filling unit shown in FIG. 1.

As best seen perhaps in FIG. 2, the outer surfaces of the intermediate section and the displacer section are cylindrical of circular cross-section. The interior surface of the intermediate section further narrows in a frustoconical neck section 29 until, at the junction with the displacer section, the passageway again becomes cylindrical. A pair of retainers or lugs 31, preferably of cylindrical shape, protrude outward from diametrically opposite locations on the outer surface 30 of the displacer section 21 for a purpose to be explained hereinafter.

Figure 4:
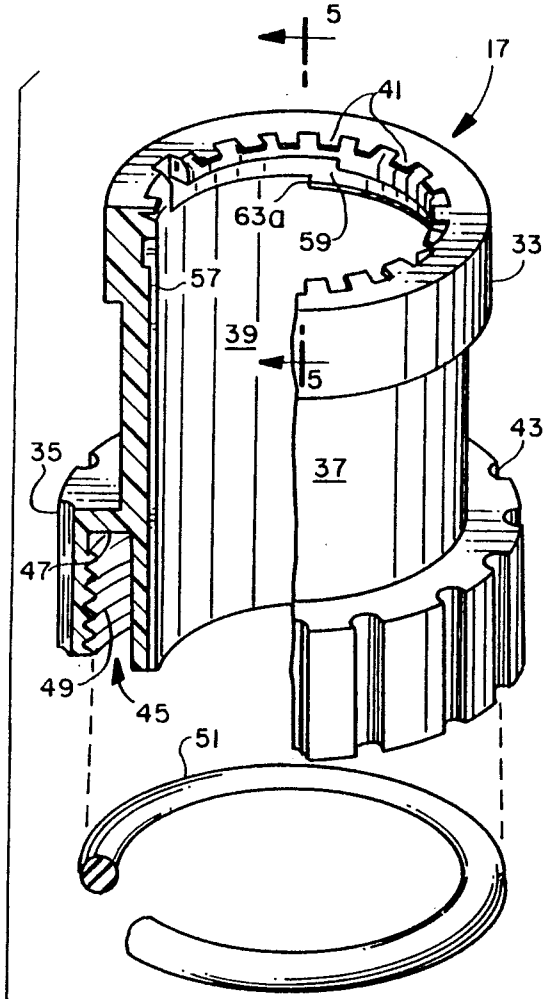
FIG. 4 is an exploded perspective view of the holder portion of the filling unit shown in FIG. 1, with portions broken away and shown in section.

The holder unit 17, as perhaps best seen in FIG. 4, includes an upper collar section 33, a lower attachment section 35 and an intermediate body portion 37. The interior surface 39 of the holder 17 is preferably cylindrical and is proportioned so as to be relatively rotatable with the outer surface 30 of the displacer section of the funnel unit. The proportioning is such that either a large gap is provided which easily drains or, preferably, a close seal is provided that deters liquid flow therebetween. The inner surface of the holder 17 is recessed slightly at its upper end in the collar region, and the uppermost portion is formed with a plurality of interrupted fingers 41 that extend radially thereinto and have interior arcuate edges that frictionally and resiliently engage against the outer surface of the funnel unit.

The lower attachment section 35 of the holder flares outward from the cylindrical body section and is preferably contoured to allow it to be gripped by one's fingers. In the illustrated embodiment, a plurality of vertical grooves 43 are provided; however, other alternative structures could be used, for example, a plurality of parallel ridges. The attachment section 35 is formed with a downwardly open cavity 45 which has an upper annular end wall 47 and an outer wall surface that is formed with internal threads 49 that mate with the usual external threads that are found on the inlet opening of the usual lawnmower or snowblower tank. The thickness of the cavity 45 is such as to accommodate the wall thickness of the usual inlet for a small tank of this type. A sealing member of annular form, preferably an O-ring 51, is preferably located at the upper end of the cavity 45 against the end wall surface 47 where it forms a seal against the upper edge of the inlet to the small tank, when the holder unit 17 of the filling unit is threaded into its installed position.

Figure 5:
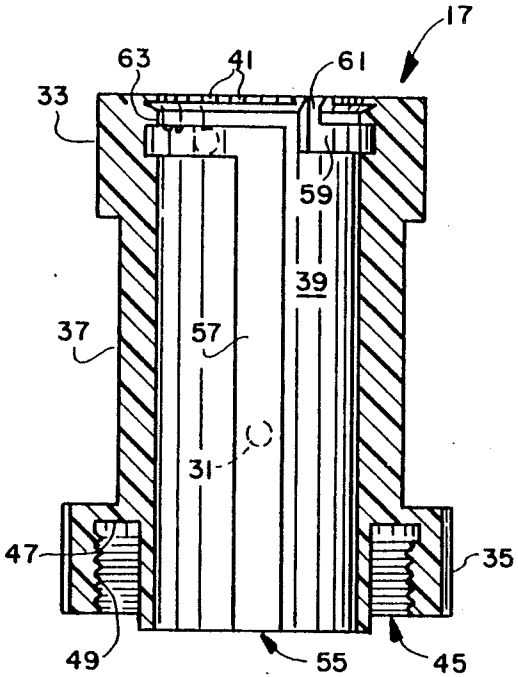
FIG. 5 is a sectional view taken along the line 5—5 of FIG. 4.

As best seen in FIG. 5, the relative movement between the funnel unit and the holder unit is provided through the interengagement of the lugs 31 within a pair of grooves 55 that are formed in the interior surface 39 of the holder. Each of the grooves 55 includes a straight vertical section 57 which is surmounted by a horizontal leg 59 which terminates in an uppermost vertical entrance leg 61. To mate the funnel unit 15 to the holder unit 17, the lugs 31 are aligned with the entrance legs 61 of the grooves, and the funnel unit is moved relatively downward so that the lugs enter the horizontal legs 59. The funnel unit is then rotated relative to the holder unit, causing the lugs 31 to partially traverse the horizontal legs leading to the upper ends of the main vertical sections 57 of the grooves 55. In this relative orientation, the filling unit is ready for installation on top of a small tank or the like that is to be filled with a flowable substance, e.g. gasoline.

To prevent inadvertent disengagement of the funnel unit from the holder unit after the two have been mated, one or more detents 63 (FIG. 5) may be provided, and a step or interruption 63*a* (FIG. 4) in the groove is also preferably provided. Such detents 63 extend sufficiently far into the horizontal leg 59 of the groove to nominally block the direct passage of the lug through this section and may be located in the horizontal leg of the groove, e.g. between the junction with the vertical leg 57 and the groove interruption 63*a*. The proportioning of the detents 63 should be such that, depending upon the resiliency of the plastic material from which the funnel unit and the holder unit are constructed, there would be sufficient spreading and/or compression to permit the lugs to be moved fairly easily therepast by twisting the two units relative to each other. If desired, the detents 63 are spaced apart so as to accommodate the lugs 31 therebetween within the horizontal leg and thus create a "lock-up" position where the two units will remain mated together with the lugs 31 seated in the horizontal legs of the grooves 55.

The threaded cap is then unscrewed from the top of the tank 13, providing access to the inlet, and the cavity 45 in the attachment section 35 is aligned with the neck of the inlet. The unit 11 is threaded downward onto the upper end of the inlet until the O-ring 51 seals against the upper edge of the gas tank inlet, thus providing a liquid and air tight seal in this region. Next, the funnel unit 15 is rotated until the lugs 31 reach the vertical sections 57 of the groove and then depressed so that the displacer section 21 slides downward within the body of the holder unit 17 so that the displacer section enters into the upper region of the tank to be filled. As best seen in FIG. 1, the downward movement of the funnel unit 15 is halted when the outward-flaring funnel section engages the upper edge of the collar section 33 of the holder.

The proportioning between the relative lengths of the filler unit 15 and the holder unit 17 is such that relative axial sliding movement equal to a distance (d) shown in FIG. 1 is permitted. This distance is substantially equal to the length of the vertical section 57 of the groove. Accordingly, when the filler unit has been moved axially downward as far as permitted, until there is engagement between the outer surface of the funnel section 19 and the upper surfaces of the fingers 41, the lugs 31 will have completely traversed the entire length of the groove sections 57 and just protrude below the undersurface of the collar section 35; in this position, twisting of the funnel unit relative to the holder unit moves the lugs out of alignment with the slots 55 and thus establishes a "lock-down". Such a lock-down position is valuable to assure that the displacer section 21 will not inadvertently float upward as the liquid level rises in the tank, thus obviating the advantage of assuring that the displacer section remains within the confines of the tank throughout the entire initial filling step. If desired, detents or shallow recesses may be provided along the bottom edge of the holder section to stabilize the lock-down position, and the lower ends of the vertical sections 57 of the grooves may be slightly flared outward so as to provide a ready entrance for the lugs 31 back into the grooves when the filling operation has been completed and it is ready to move the funnel unit upward into its lock-up position.

The filling of the tank proceeds, with the funnel unit in the lock-down position, by pouring liquid into the funnel section and allowing it to run downward through the interior passageway of the intermediate section and the displacer section into the tank. Air within the tank can initially escape either upward through the interior passageway or the air vent system or both until the liquid level rises above the bottom of the displacer section 21, thereafter, air escaped through an air vent system provided via the two grooves 55 in the interior surface of the holder section. With the funnel unit in the lock-down position, these grooves provide completely open vent passageways; however, air flow from the tank will slow once the level blocks entrance to the interior passageway causing the liquid to more slowly flow out of the funnel and alerting the person pouring the liquid that the tank is nearly full. Eventually, when the level of the liquid within the tank rises above the lower end of the holder section 17 so that air can no longer reach the grooves 55, air will become trapped within the tank and eventually become compressed, preventing the further inflow of liquid. At this time, the person filling the tank should stop pouring liquid into the funnel when the liquid reaches a reference level in the funnel unit; preferably a mark 62 (FIG. 2) of some type is used to provide a visual indication of a level above which the liquid level should not exceed, which with the proportions shown is conveniently located at the junction between the funnel section 19 and the intermediate section 23.

After the person filling the tank stops pouring, he simply manually grasps the upper end of the funnel unit 15, rotates it until the lugs 31 enter the bottoms of the grooves, and pulls it vertically upward causing the lugs to slide upward in the vertical legs 57 of the grooves until they reach the horizontal legs 59. Further rotation until the lugs engage the detents 63 moves the unit into the lock-up position. The upward removal of the displacer section 21 from the tank provides additional volume within the tank to accommodate all of the liquid that earlier filled the funnel section up until the desired predetermined line. As best seen in dotted outline in FIG. 5, the width of the grooves is substantially greater than the diameter of the lugs so that there is clearance through which any air being displaced can freely flow past the lugs as they slide up the vertical legs 57 of the grooves. The holder section 17 can then be unscrewed by grasping the outer surface of the attachment section 35, and once it is removed, the tank cap is replaced. Thus, it can be seen that the filling unit 11 allows the rapid and accurate filling of a small tank to a full condition without the danger of overfilling the liquid.

Figure 10:
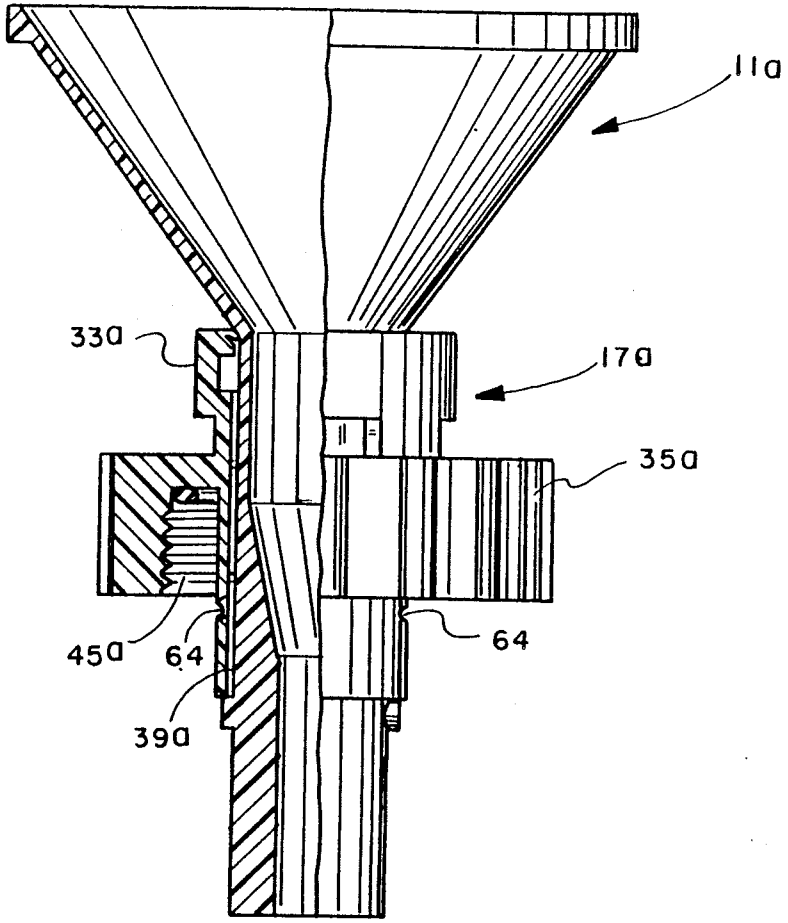
FIG. 10 is a view similar to FIG. 1 of a further version of a filling unit embodying various features of the invention.

If it is desired to totally fill a tank regardless of its shape and therefore without regard to the amount of volume that might remain from compressed air or to provide more precise two-step liquid venting of air that will slow the outflow of liquid from the funnel as it nears the full state, the alternative embodiment shown in FIG. 10 may be used. In this version, a modified holder section **17*a* has a collar section 33*a* is located closer to the attachment section 35*a* so that the unit 11*a* sits lower on the tank. The inner portion of attachment section which defines the interior surface 39*a* extends well beyond the threaded cavity 45*a* into the tank. One or two smaller vent passageways 64 are provided through the sidewall of the holder in the region of the grooves so that, when the bottom of the holder becomes submerged so that air from the tank can no longer enter into the bottom of the vertical legs of the grooves, air can still escape through the vent passageways 64 in the sidewall to reach the grooves and continue to allow the tank to fill. Because the only entrance through the passageways 64 into the vertical legs of the grooves will be through the passageways 64, air will not be able to escape from the tank at the same rate as it escaped when it could also enter through the bottoms of the grooves. As a result, the liquid will begin to flow considerably more slowly downward from the funnel section into the tank, and this will give the person filling the tank an indication that it is nearing full condition because the air is escaping only through the smaller vent holes 64** in the sidewall. This arrangement serves as a telltale, and the person filling the tank will then begin to pour the liquid more slowly and will be able to halt pouring with the liquid very near the desired level at a reference mark or other indication in the interior surface of the funnel unit.

Figure 11:
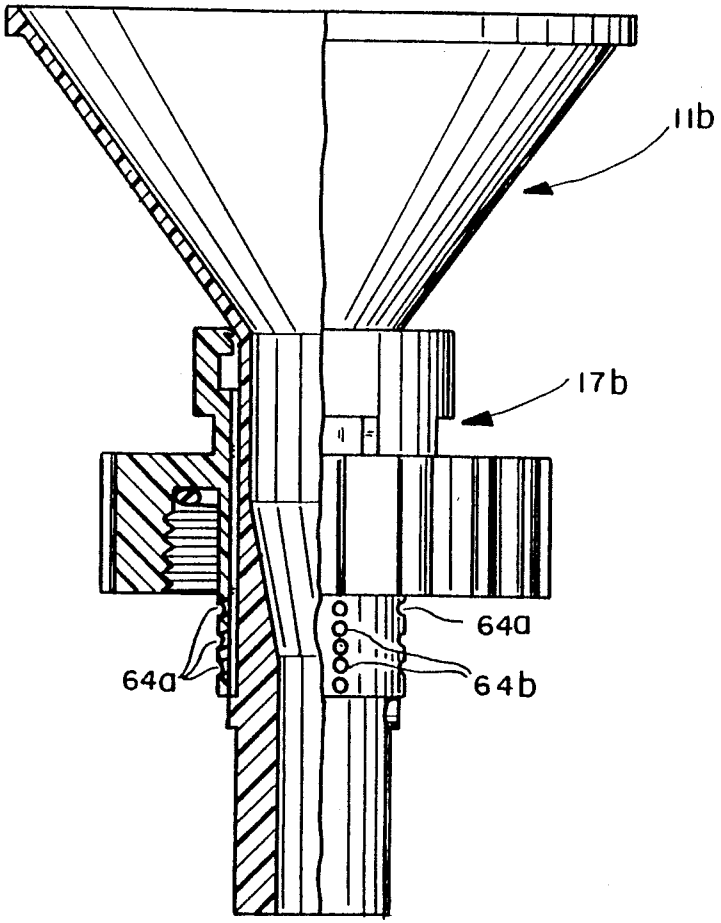
FIG. 11 is a view similar to FIG. 1 of yet another version of a filling unit embodying various features of the invention.

Illustrated in FIG. 11 is a further alternative filling unit **11*b* similar to that shown in FIG. 10. Instead of having only a single vent hole 64*a* leading into each of the vertical legs of the groove, a series of three vent holes 64*a* are provided. In addition, a further set of vent passageways 64*b* are provided in a vertical line through the sidewall of the holder unit 17*b*. Although these holes 64*b* will not communicate directly with the grooves, by proportioning the interior passageway of the holder unit 17*b* to be just slightly oversized with regard to the outer diameter of the filler unit, communication to the grooves will be provided. The illustrative arrangement provides still further notice to the person filling the tank because the rate of flow of liquid into the tank will gradually decrease as more of the vent passageways 64*a* and 64*b*** become submerged below the liquid level, retarding the outflow of air from the container. Such an arrangement still further facilitates being able to halt the pouring of liquid at the desired level.

Figure 6:
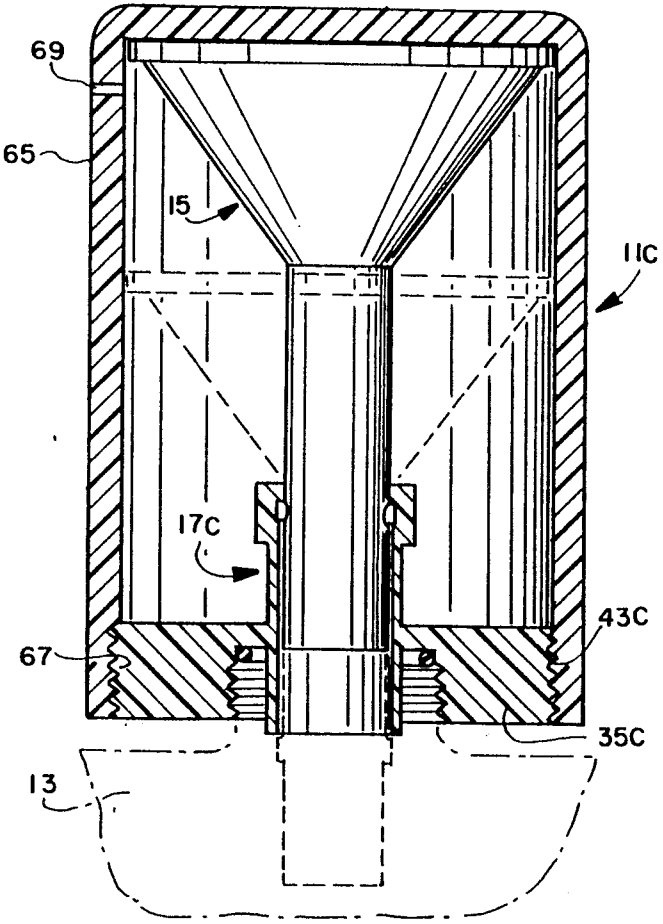
FIG. 6 is an elevational view, shown in section, of an alternative embodiment of a filling unit embodying various features of the invention, which is quite similar to that depicted in FIGS. 1–5 except that the holder portion is adapted to support a threaded cap, illustrated as it would be mounted on a small gas tank of a lawn mower or the like when the mower would be operated, with a cap installed in a position which closes the unit.
Figure 3:
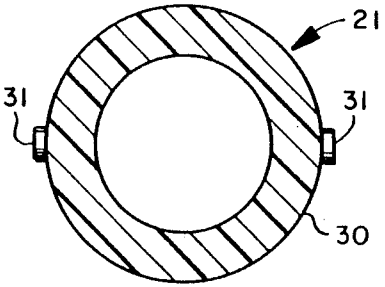
FIG. 3 is a sectional view of the funnel portion of FIG. 2 taken generally along the section line 3—3 of FIG. 2.

Depicted in FIG. 6 is an other alternative embodiment of a filling unit **11*b* very similar to that shown in FIGS. 1 through 5. The funnel unit portion 15 may be exactly the same as that described previously, and the holder unit 17*c* is slightly different. The holder unit 17*c* has a wider collar 35*c* which has exterior threads on its outer circular periphery 43*c*. A cap 65 having mating internal threads 67 at its open, lower end is provided which is generally cylindrical shape having an interior diameter just slightly larger than the diameter of the rim of the funnel section so that it will fit over and enclose the funnel unit 15 when the funnel unit is in the raised or lock-up position, as depicted in full lines in FIG. 6. A vent 69 is provided in the sidewall of the cap so as to allow the escape of vapor to prevent pressure buildup inside the tank when the cap 65** is in place.

The filling unit **11*c* is designed for semipermanent installation on a small tank, such as that of a gasoline powered lawnmower, by threading the collar section 35*c* of the holder onto the upstanding inlet of the tank 13 until the O-ring creates a seal with the upper edge of the inlet. With the cap 65 removed, it can be seen that the funnel unit can be slidably moved downward into the filling or lock-down position (shown in dotted outline in FIG. 6), and then when filling is completed so that the liquid extends upward to the desired level in the funnel section, it can be raised so as to lift the displacer section from the interior of the tank and allow the liquid to flow downward completing the total filling of the tank. The cap 65** can then be reinstalled, and the lawnmower or other device operated in its normal fashion.

Figure 9:
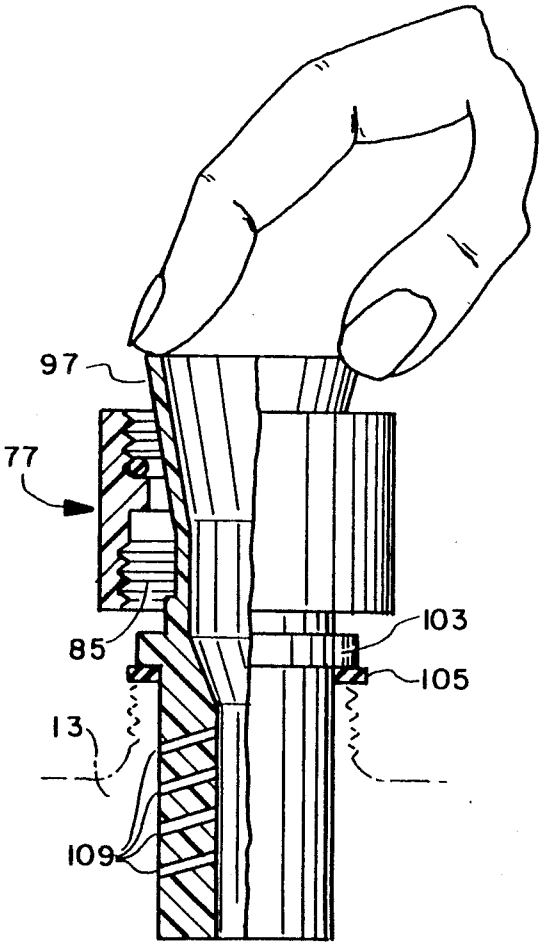
FIG. 9 is a view similar to FIG. 8 with the funnel portion being held down against the upper end of the inlet to the gas tank while the holder portion has been rotated to disengage it from the external threads thereupon.
Figure 8:
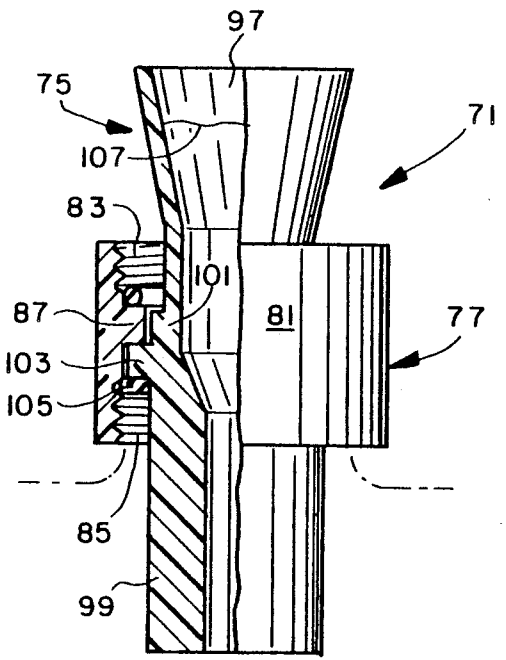
FIG. 8 is a view of the filling unit of FIG. 7 with the cap removed and with the filling unit in the operative position, upside-down from the orientation shown in FIG. 7, and screwed onto the gas tank.
Figure 7:
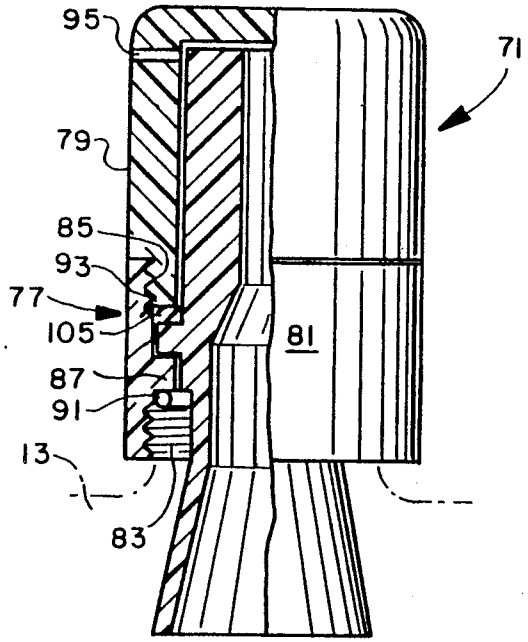
FIG. 7 is an elevational view, with the left half being shown in section, of another alternative embodiment of a filling unit embodying various features of the invention.

Shown in FIGS. 7 through 9 is a third alternative embodiment of a filling unit 71 which has a funnel unit 75 and a holder unit 77, which is also adapted to carry a cap 79 and is thus designed to be left in place on the inlet of a gasoline tank as part of a semipermanent installation. However, a major difference in the unit 71 is that it is constructed so that the combined filling unit and holder unit can be inverted between an operative or filling orientation (shown in FIG. 8) and a storage orientation (shown in FIG. 7). To facilitate such attachment to the inlet of a tank 13 in the two inverted positions, the holder portion 77 is formed with two sets of internal threads, both proportioned to mate with the usual external threads on the inlet from a small tank.

More specifically, the holder unit 77 has an exterior cylindrical sidewall 81 which could be provided with grooves or ridges, if desired, to facilitate its screwing onto, and unscrewing from, the inlet of a small gasoline tank. A central passageway through the holder is provided, having generally the internal diameter of the two sets of internal threads, namely, as shown in FIG. 7, a lower set of threads 83 and an upper set of threads 85. These two threaded portions are interrupted by an inwardly extending flange 87. A sealing ring, such as a synthetic rubber washer or an o-ring 91, is located at the upper end of the lower set of threads 83 adjacent the underside of the flange 87 to provide a seal against the upper edge of the inlet to the tank 13, as explained hereinbefore. It is preferably sized so as to be reliliently retained in place once installed by a friction fit at its outer edge adjacent the threads. In the storage position shown in FIG. 7, the upper set of threads 85 accepts a set of mating external threads 93 provided at the open end of the cap 79 to allow the cap to be installed in position enclosing the upwardly extending portion of the funnel unit. The cap 79 is provided with a vent 95 in the sidewall to permit the escape of vapor and avoid a pressure buildup with the tank 13.

As best seen perhaps in FIG. 8, the filling unit 75 has a funnel section 97 at one end and a displacer section 99 at the opposite end, which are joined by an intermediate body section 101. The funnel section 97 flares inward from its end and is generally frustoconical in shape, whereas the displacer section 99 is generally tubular having a thick sidewall section (e.g. at least about 3 times thicker than the funnel section) that displaces a substantial amount of liquid when it is disposed (as shown in FIG. 8) extending downward into a tank 13. The intermediate body section includes an outwardly extending flange 103 which has an outer diameter greater than the interior diameter of the interior surface of the inwardly extending flange 87 of the holder unit so that there is abutment of one flange against the other, as shown in FIG. 8. An O-ring or a compressive washer 105 is provided which is sized to fit tightly against the exterior tubular surface of the funnel unit 75 being positioned against the undersurface of the flange 103, as shown in FIG. 8, and thereby providing a seal against the upper edge of the inlet to the gas tank when the filling unit 71 is attached to the tank in its filling position.

In order to refill the tank 13 with gasoline or other suitable fluid, the cap 79 is removed from the unit when it is installed on the tank in the orientation shown in FIG. 7, either before or after the holder section 77 is unscrewed from the tank 13 and withdrawn therefrom. Following removal of the cap, the filling unit is inverted so that the displacer section 99 faces downward, and it is inserted in this orientation into the inlet of the tank 13. The holder 77 is then threaded back into engagement with the tank threads, this time using the set of threads 85, until there is a seal between the O-ring 105 and the upper edge of the tank inlet. Such a seal is effected and maintained by threading the holder section 77 down snugly onto the threads of the inlet while the abutting surfaces of the flanges 87 and 103 rotate slidable against each other. In this orientation, the funnel portion 97 extends upward into a position to receive gasoline or other liquid to be poured thereinto.

Filling is continued until the level of liquid reaches a predetermined level, such as the mark 107 about midway within the funnel section. In order to permit air to escape from the tank when the level of liquid in the tank gets above the bottom of the displacer section 99, several vent passageways 109 are preferably provided in the displacer section 99 at different vertical levels. The passageways 109 are located and oriented at an angle to the horizontal to allow air to vent even though liquid is flowing downward in the throat of the funnel. By employing larger diameter passageways 109 near the bottom, a gradual but distinct slowing in the flow of liquid out of the funnel will warn that the tank is nearly full. When the desired level is reached, the person performing the filling places the fingers of one hand atop the upper edge of the filler section 97 and holds it firmly, pressing downward so that the O-ring or other rubber washer 105 maintains the seal between the upper edge of the tank inlet and the undersurface of the flange 103. With the other hand, the person unscrews the holder unit 75 from the tank inlet until there is complete disengagement of the threads 85, as shown in FIG. 9. With the holder section disengaged, the person then quickly withdraws the filling unit by pulling upward on the funnel section 97; the smooth cylindrical outer surface of the displacer section 99 permits it to slide upward and outward along the interior wall of the tank inlet. By removing the displacer section rapidly, void volume is immediately provided in the tank which can accommodate all of the liquid in the funnel section 97 without any overflow from the tank inlet. After again inverting the filler unit 71, the funnel portion 97 is inserted into the inlet of the tank, and the holder is then reinstalled on the threaded inlet using the set of threads 83. The cap 79 is then threaded back into its storage orientation using the set of threads 85, and the lawnmower or other apparatus is ready for use.

Although the invention has been described with respect to several preferred embodiments, it should be understood that one having the ordinary skill in the art could make various modifications and changes to the disclosed embodiments without deviating from the invention which is defined by the claims appended hereto. For example, although threaded interconnections are shown, other suitable types of interconnections, e.g. bayonet connections, can alternatively be used. Although O-rings are generally shown, other types of sealing arrangements can be used that employ the normal elastomeric, compressive materials i.e. rubber washers, and frequently the type of sealing material that will be employed will be dependent upon the fluid to be received in the tank in question, with which it must, of course, be compatible. Although the filling unit is expected to find its primary use in filling tanks with fuel, it can be used with any liquids or flowable solids, even with fluidized particulate materials. The holder sections and filter sections are preferably molded from suitable tough thermoplastic or thermosetting polymeric material, which material should also be resistant to crazing or other degradation by the fluids to be handled. Although preferred vent arrangements are illustrated, other passageway orientations may be used, including extensions that project upward from the funnel unit.

Particular advantages of the invention are emphasized in the claims which follow.

What is claimed is:

1. A filling unit to prevent overfilling of a container having an inlet formed with attachment means for attaching a closure to said container inlet, which filling unit comprises a body having a portion with mating attachment means proportioned to engage said attachment means on said container inlet and to seal therewith, funnel means for receiving liquid in engagement with said body and extending upward therefrom and providing an always open passageway into said container, and displacer means integral with said funnel means and being located in engagement with said body and extending below the level of said body portion having said mating attachment means, said funnel means-displacer means combination being slidably received in a passageway in said body and being slidable within said body passageway between a lower filling position and an upper removal position, so that when said container is filled with liquid so that such liquid extends upward to a predetermined level in said funnel means, said displacer means displaces a predetermined substantial amount of liquid in the container, said predetermined amount being at least equal to the volume of liquid accommodated in said funnel means up to said predetermined level so that filling may be carried out so that the liquid level extends above the upper end of said container inlet to a visible location within said funnel means up to said predetermined level, the interior surface of said body and the exterior surface of said funnel means-displacer means combination being formed with lug means and complementary groove means for guiding relative movement therebetween, said groove means being sized to provide air vent passageway means which extends from a location within said container to a location which is vertically open to the atmosphere thereabove, whereby removal of said displacer means from within the container causes the liquid level to drop to a level below the upper end of said inlet and all the liquid remaining in said funnel means to drain into said container through said always open passageway.

2. A filling unit in accordance with claim 1 wherein the displacer means portions of said combination has a wall section that is thicker than the wall section of said funnel means.

3. A filling unit according to claim 1 wherein said body is rotatable relative to said integral funnel means-displacer means.

4. A filling unit according to claim 1 wherein said body has a circular cylindrical interior of substantial height which defines said passageway.

5. A filling unit according to claim 1 wherein said funnel means has an elongated neck portion which is slidable received in said passageway, a wide mouth portion surmounting said neck portion and retainer means carried by said neck portion which prevents the upward inadvertent disengagement of said funnel means from said body.

6. A filling unit to prevent overfilling of small tanks having an externally threaded inlet and a removable cap, which filling unit comprises a body having an internally threaded lower end proportioned to threadably engage the external threads on said tank inlet, having means for sealing with said tank inlet, and also having an upstanding portion of substantial height which defines a cylindrical interior passageway, a funnel having an elongated neck portion of circular cross-section which is slidably received in said interior passageway and having a wide mouth portion surmounting into said tank, the exterior surface of said neck portion having means which prevents the upward inadvertent disengagement of said funnel from said body, said exterior surface of said neck portion and said interior passageway being proportioned so that an air passageway is always provided between said exterior surface and said interior passageway, said funnel being movable within said interior passageway of said body between a lower filling position and an upper position, the lower portion of said funnel having a wall section that is at least three times thicker about its complete circumference than the wall section which forms the wide mouth portion and displaces a predetermined substantial amount of liquid when the liquid level in the tank extends upward to a visible location in said funnel and said funnel is located in its filling position, said predetermined amount being such that, if filling is carried out so that the liquid level extends above the upper end of said threaded inlet to said visible location within said funnel, shifting of said funnel to its upper position causes the liquid level to drop to a level below the upper end of said threaded inlet and all the liquid remaining in said funnel means to drain into said tank through said always open passageway, said thicker wall lower portion of said funnel being slidably shiftable to its upper position without disengagement of said sealing engagement between said tank inlet and said lower end of said body.

7. A filling unit according to claim 6 wherein said funnel contains a level marking at the desired filling level that is visible from the top of said funnel.

8. A filling unit according to claim 6 wherein said neck portion and said body collar portion are circular in cross-section and proportioned so that liquid flow is prevented between said body portion defining said interior passageway and said funnel neck portion.

9. A filling unit according to claim 8 wherein groove means is provided in the surface defining said interior passageway of said body and lug means proportioned to be received therein protrudes outward from the exterior surface of said funnel neck portion.

10. A filling unit according to claim 9 wherein said groove means is of an enlarged cross-sectional size relative to said lug means to provide said air passageway.

11. A filling unit to prevent overfilling of a container having an inlet formed with attachment means for attaching a closure to said container inlet, which filling unit comprises a first unit having upstanding funnel means for receiving liquid having a neck portion with an exterior surface surrounding the neck portion wherein said funnel means is formed integrally with depending displacer means and providing an always open passageway into said container, said funnel means having a visible upper level mark, and a second unit having a portion with first mating attachment means proportioned to engage said attachment means on said container inlet and seal thereto, said second unit having interior passageway means proportioned to slidably receive said first unit so that said funnel means extends upward therefrom and so that said displacer means extends therebelow to a level so that it displaces a predetermined substantial amount of liquid in the container when said first unit is slidably rectilinearly moved to a lower filling position and when filling with liquid to said upper level mark is carried out, said exterior surface of said neck portion and said interior passageway means in said second unit being proportioned so that an air passageway is always provided between said exterior surface and said interior passageway, said first unit having retainer means which interengages with said second unit and prevents inadvertent disengagement of said first and second units when said first unit is moved slidably rectilinearly upward to an uppermost removal position, said predetermined amount being such that filling may be carried out so that the liquid level extends to said visible upper level mark within said funnel means, whereby removal of said displacer means from within the container causes the liquid level to drop to a level below the upper end of said inlet and all the liquid remaining in said funnel means to drain into said container through said always open passageway and whereby said movable dispenser means and said integral funnel means of said first unit can rectilinearly move between its filling and removal positions without disengaging said first mating and sealing attachment means from its connection with said container inlet.

12. A filling unit according to claim 11 wherein said first and second units are rotatable relative to each other and have abutting surfaces which are perpendicular to the axis of said relative rotation.

13. A filling unit according to claim 12 wherein the displacer means portion of said first unit has a wall section that is substantially thicker than the wall section of said funnel means.

14. A filling unit according to claim 12, wherein said second unit has second mating engagement means extending in the opposite axial direction from said first mating engagement means and wherein said funnel means is proportioned to fit through said tank inlet.

15. A filling unit according to claim 14 wherein a cap is provided which fits over and envelops said funnel means and which has means for interchanging with said mating engagement means of said second unit.

* * * * *